United States Patent [19]

Lesnick et al.

[11] 4,020,818

[45] May 3, 1977

[54] OIL PRESSURE DELAY CHECK VALVE AND PRESSURE SWITCH FOR SHUTTING OFF DIESEL ENGINE UPON DROP IN OIL PRESSURE

[75] Inventors: George Lesnick, South Holland, Ill.; John M. Marshall, Crown Point, Ind.

[73] Assignee: Controlled Power Products Company, Oak Brook, Ill.

[22] Filed: Dec. 1, 1975

[21] Appl. No.: 636,543

[52] U.S. Cl. ..... 123/198 DB; 123/41.15; 123/196 S; 200/83 T

[51] Int. Cl.[2] ..... F02B 77/08

[58] Field of Search ... 123/198 D, 198 DB, 198 DC, 123/196 S, 41.15, 110; 200/83 T

[56] References Cited

UNITED STATES PATENTS

| | | | |
|---|---|---|---|
| 872,039 | 11/1907 | Adams | 123/41.15 |
| 2,222,542 | 11/1940 | Robison | 123/198 DC |
| 2,558,830 | 7/1951 | Drane et al. | 200/83 T X |
| 2,648,016 | 8/1953 | Van Gastle | 200/83 T X |
| 2,702,840 | 2/1955 | Jackson et al. | 200/83 T |
| 3,060,290 | 10/1962 | Gagan | 200/83 T X |
| 3,202,161 | 8/1965 | Richards | 123/198 D X |
| 3,533,390 | 10/1970 | Goodwin | 123/198 DB |
| 3,533,391 | 10/1970 | Lockmuller | 123/198 DB |
| 3,590,798 | 7/1971 | Goodwin | 123/198 D |
| 3,853,110 | 12/1974 | Van der Meowe | 123/198 D X |

*Primary Examiner*—C. J. Husar
*Assistant Examiner*—Ira S. Lazarus
*Attorney, Agent, or Firm*—Hill, Gross, Simpson, Van Santen, Steadman, Chiara & Simpson

[57] ABSTRACT

Oil pressure delay check valve and pressure switch for unattended Diesel engine to shut off the fuel supply valve after a low oil pressure signal, and to delay opening of the valve for a predetermined time interval. This delay is attained by the closing of a normally open pressure switch upon pressures decreasing from the order of 8 psi and by bleeding the oil pressure past a check valve through a bleeder tube in cooperation with an accumulator, from a pressure in the order of 8 psi to a pressure in the order of 5 psi to accommodate the opening of a normally closed switch as the pressure decrease from the order of 5 psi. The two switches are in series and when closed, energize the solenoid of an electrically energizable valve to shut off the supply of fuel to the Diesel engine. As the oil pressure decreases, one pressure switch will close and remain closed while the other pressure switch will open in a predetermined time delay interval and effect opening of the fuel supply valve. The delay check valve connected with the oil pressure manifold of the engine is spring-biased into a closed position and has the bleeder tube leading therethrough affording communication between the valve inlet and the valve chamber. The normally closed pressure switch in series with the main oil supply pressure switch is connected with the valve chamber and receives pressure therefrom. An accumulator connected with the valve chamber accumulates oil under pressure and when the oil pressure reaches 8 psi or more, the normally open switch will close, and when the oil pressure in the valve chamber drops below 8 psi, the trapped oil pressure will bleed down through the bleeder tube to 5 psi, and accommodate opening of the fuel supply valve and the establishment of the supply of fuel to the engine.

10 Claims, 3 Drawing Figures

OIL PRESSURE DELAY CHECK VALVE AND PRESSURE SWITCH FOR SHUTTING OFF DIESEL ENGINE UPON DROP IN OIL PRESSURE

FIELD OF THE INVENTION

Control for unattended Diesel engine disconnecting the fuel supply valve after a positive shut-down and delaying opening of the valve for a predetermined time delay interval.

BACKGROUND, SUMMARY AND ADVANTAGES OF INVENTION

The patents to Smyers, Jr. et al, U.S. Pat. No. 3,535,479; Drane et al. U.S. Pat. No. 2,558,830 and Robison U.S. Pat. No. 2,456,994 disclose time delay pressure switches which open and close an electrical circuit in response to changes in pressure in a fluid conduit, in which the delay is attained either by bleeding air into the actuating chamber for the switch, or by bleeding pressure past a regulating valve to provide a delayed action and regulation of the speed of operation of a switch arrangement.

While such valves and systems have been satisfactory for the particular uses for which they have been designed, the check valve and system of our present invention is an improvement over the prior time delay systems in that a positive shut-off of fuel is attained for a Diesel engine upon loss in oil pressure in a far simpler manner than the prior art delays mentioned above, providing an effective, low-cost unit disconnecting the fuel supply valve after a positive shut-down, to prevent the battery from running down, and particularly adapted for an unattended engine in delaying opening of the fuel supply valve for at least 30 seconds as pressure decreases by bleeding the pressure down through a bleed tube leading through the check valve, from 8 psi to 5 psi in cooperation with an accumulator accumulating oil so at 8 psi, the pressure will bleed down to 5 psi and lower.

The advantages of the present invention, therefore, are that the effectiveness of the shut-off system is attained at a reduced cost by the passing of a bleeder tube through the check valve to bleed down the oil pressure as the engine stops or as there may be a leakage of oil, and by the provision of an accumulator in the valve chamber, and a pressure switch associated with the valve chamber, controlled by the accumulator and bleeder tube and opening at predetermined pressures to effect opening of the fuel shut-off valve and provide a delay in restarting the engine.

A further advantage of the invention is the provision of a simple and inexpensive time delay unit for Diesel engines disconnecting the fuel valve for the engine and preventing accidental restarting of the engine for a predetermined time delay interval.

A still further and important advantage of the invention is the control of a fuel shut-off valve of a Diesel engine by a normally open and a normally closed pressure switch in series and energizing a fuel shut-off valve to shut off the supply of fuel to the engine upon predetermined low pressure conditions in which the normally closed pressure switch opens and the normally open pressure switch closes on lower predetermined decreasing pressures to provide a time delay in opening of the fuel shut-off valve for restarting of the engine.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure.

DESCRIPTION OF PREFERRED EMBODIMENT OF INVENTION

Figure 1:
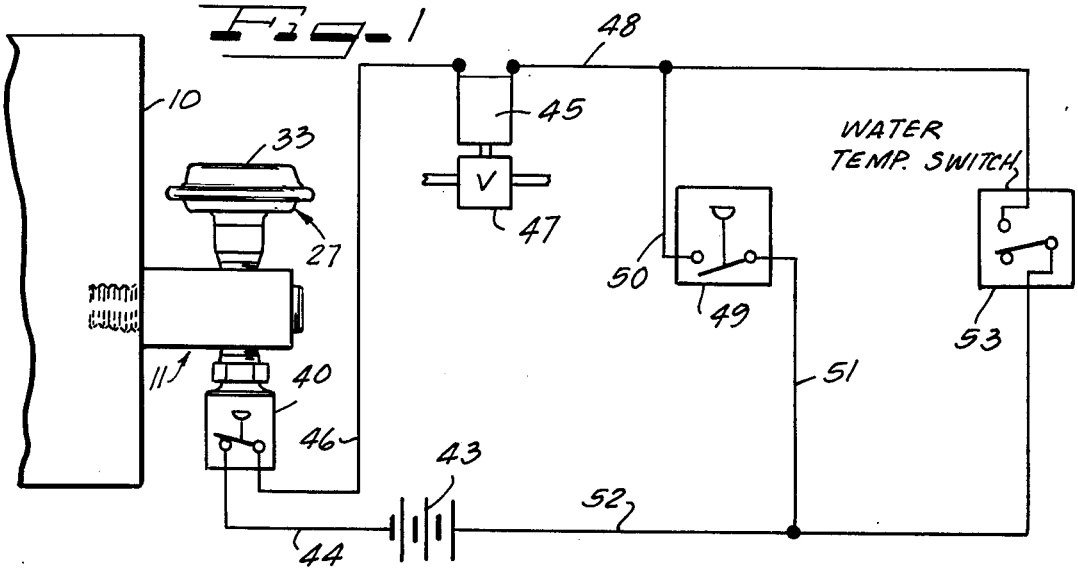
FIG. 1 is a schematic diagram illustrating a check valve in communication with a Diesel engine cylinder block and diagrammatically showing the control for shutting off the supply of fuel upon drops in oil pressures below safe operating pressures or increases in water temperature above a predetermined temperature.
Figure 2:
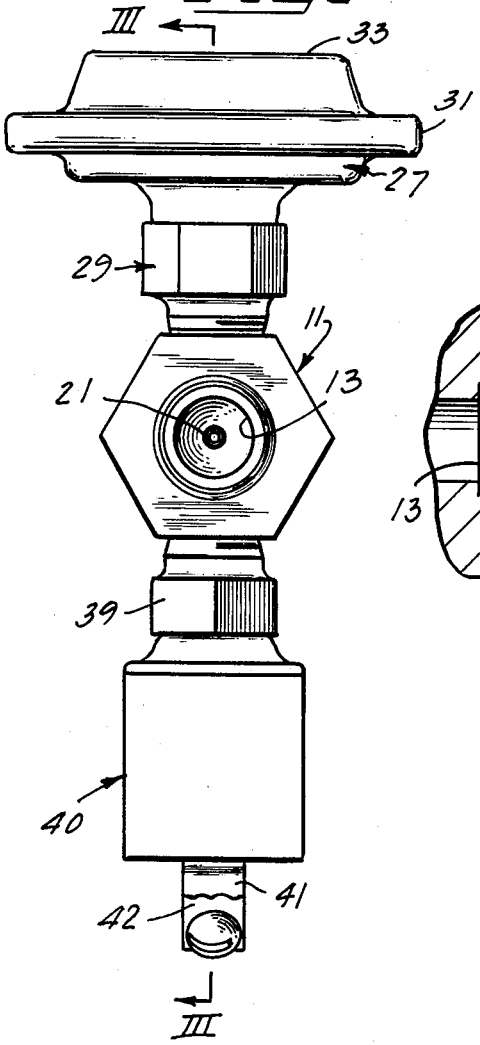
FIG. 2 is an end view of the check valve, looking at the valve toward the end thereof having communication with oil under pressure in the oil manifold.
Figure 3:
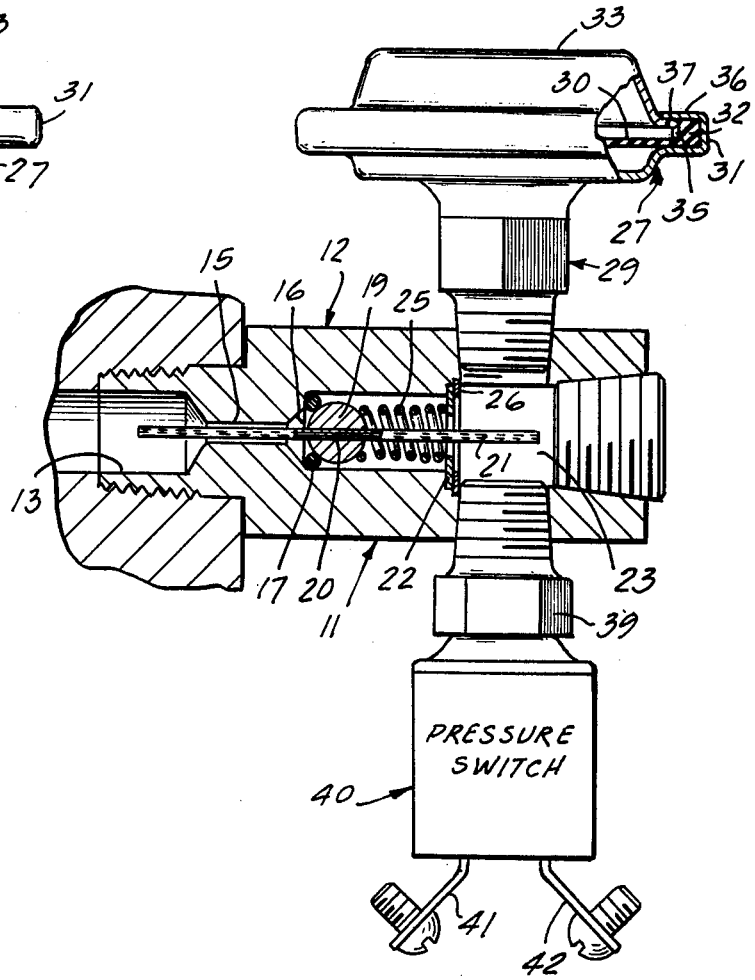
FIG. 3 is a partial fragmentary sectional view taken substantially along line III—III of FIG. 2.

In the embodiment of the invention illustrated in the drawings, we have shown a portion of the oil manifold of a Diesel engine cylinder block 10 having a time delay check valve 11 constructed in accordance with the principles of the present invention, threaded in the cylinder block in communication with oil under pressure in the oil manifold in the cylinder block, it being understood that the normal oil pressure during operation of the engine is from 45 to 60 pounds. The delay check valve is shown as a ball-type of check valve, including a valve block 12 having an inlet passageway 13 leading thereinto to a reduced diameter passageway 15 leading along the valve block. The passageway 15 flares at its downstream end in a frusto-conical form to a valve seating portion 16 having a valve seat 17 therein. The valve seat 17 is shown as being an O-ring, but need not necessarily be an O-ring and may be of any form required to conform to a check valve member 19. The check valve member 19 is shown as being in the form of a ball having a diametrical passageway leading therethrough, through which extends a bleeder tube 21 opening at one end in the enlarged diameter inlet 13 of the valve block and extending axially through the passageway 15 along the center thereof and through the check valve 19 and seat 22 and opening into a chamber 23 to bleed oil under pressure in the chamber 23 back to the inlet 13, upon stopping of the engine or sudden drops in oil pressure. A spring 25, herein shown as being a compression spring, is seated on the annular seat 22 at one end and on the ball-type check valve 19 at its opposite end, to maintain the check valve closed upon low pressure conditions. The seat 22 may be held in position by a snap-ring 26 seated in a recessed portion of the valve chamber and snapped in position therein.

The valve chamber 23 has communication with an accumulator 27 extending from one side thereof and shown as having an inlet fitting 29 threaded in the valve block 12. The inlet fitting 29 is connected with an enlarged diameter pressure accumulator chamber closed by a flexible diaphragm 30. The accumulator 27 is of a conventional form and the pressure accumulator chamber closed by the flexible diaphragm 30 is shown as having an annular peripheral portion bent to a radially inwardly extending generally U-shaped form and extending about a rectangular bead 32 extending about the periphery of the diaphragm 30. The accumulator also has an inverted dish-like cover portion 33 having a flat peripheral portion 37 having an axial flange 38 extending about the inner wall of the bead 32 and clamped into engagement with the diaphragm 30 by an annular leg 36 of the radially inwardly opening U-shaped peripheral portion 31 of the pressure chamber.

The chamber 23 also has communication with a fitting 39 threaded on the opposite side of the valve block 12 from the fitting 29 and having communication with a pressure switch 40. The pressure switch 40 is normally closed and opens upon decreasing pressures to pressures of 5 psi and below. The switch itself is diagrammatically shown in FIG. 1 and may be of a conventional form, so need not herein be described in detail.

Terminals 41 and 42 extend from the casing for the pressure switch, one terminal, which may be the terminal 41, is connected with a battery 43 by a conductor 44. The other terminal 42 is connected with one terminal of a solenoid 45 by a conductor 46. The solenoid 45 is electrically energizable to close a solenoid operated valve 47 closed upon energization and opened upon deenergization of said solenoid. The other terminal of the solenoid 45 is connected with a conductor 48 having connection with an oil pressure switch 49 in the main oil pressure line through a conductor 50. The pressure switch 49 may be connected in the main oil pressure line, and is normally open and closes at pressures in the order of 8 psi decreasing. The other terminal of the normally open pressure switch is connected with the battery 43 through conductors 51 and 52.

FIG. 1 of the drawings also shows a water temperature switch 53 connected with the conductor 48 and the conductor 52 and normally open, but closing at temperatures of 209° F. increasing.

The pressure switch 40 is normally closed while the pressure switches 49 and 53 are normally open. Thus, upon increases in water temperature above 209° F., the solenoid 45 will be energized to close the shut-off valve 47 and shut off the supply of fuel to the engine. The engine will then stop.

At this time, the pressure switch 49 will be open and as the oil pressure drops to pressures below 8 psi decreasing, the oil pressure switch 49 will close and establish an energizing circuit to the solenoid 45 of the fuel shut-off valve 47, to hold the fuel shut-off valve closed as the temperature decreases to a temperature where the water temperature switch opens. Upon further decreases in pressure in the chamber 23, to pressures below 5 psi, the normally closed switch 40 will open to effect deenergization of the solenoid 45 and opening of the fuel supply valve 47. As the pressure increases to pressures above 8 psi, the oil pressure switch 49 will open while the oil pressure switch 40 will close and remain closed during normal operation of the engine.

As the pressure decreases below 8 psi and continues to decrease to 5 psi and under, a time delay in the order of 30 seconds will occur before the solenoid 45 will be deenergized and the fuel supply valve 47 will open to enable starting of the engine.

It should here be understood that during normal oil pressure conditions, pressure will build up in the accumulator 27. Upon closing of the check valve and a drop in oil pressure to zero, the accumulator 27 will provide pressure to hold the pressure switch 40 closed while the bleeder tube 21 will bleed pressure from the chamber 23 and accumulator. As pressure in the main oil line drops to 8 psi and decreases below 8 psi, the pressure switch 49 will close. As the bleeder tube 21 bleeds pressure from the chamber 23 to pressures in the order of 5 psi decreasing, the pressure switch 40 will open to effect deenergization of the solenoid 45 and the opening of the fuel shut-off valve, to accommodate starting of the engine.

The bleeder tube 21 thus governs the delay in opening of the pressure switch 40 and thereby provides the time delay between closing of the pressure switch 49 and shutting off of the fuel supply valve, and opening of the pressure switch 40, to deenergize the solenoid 45 and effect the supply of fuel to restart the engine.

It should be understood that the time delay is governed by the bleeder tube 21, which may have an opening of substantially .013 inch in diameter and that the delay may be varied by varying the opening in the bleeder tube or varying the pressures at which the pressure switch 40 opens and the pressure switch 49 closes. The accumulator 27 further accumulates sufficient pressure to prevent intermittent opening and closing of the pressure switch 40 and to provide a substantially constant time delay in opening of the fuel valve 47 after the pressure in the oil manifold drops to zero and the pressure switch 49 closes while the pressure switch 40 opens under control of the bleeder tube 21 and the accumulator 27.

We claim as our invention:

1. In an automatic shut-off for the fuel supply to a Diesel engine upon drop in oil pressure and in combination with an engine cylinder block having an oil pressure manifold therein, a delay check valve having communication with the oil pressure manifold in the cylinder block including a valve body having a valve chamber therein and an oil pressure inlet to said chamber, an oil pressure passageway leading from said inlet to said chamber in said valve body, a valve seat at the downstream end of said passageway, said valve chamber being downstream of said valve seat, a check valve in said chamber yieldably biased into engagement with said seat to block the flow of oil out of said chamber upon low pressure oil conditions, a normally closed pressure switch having communication with said valve chamber and opening upon predetermined decreasing pressure conditions, a main oil pressure switch in the oil line to the engine and normally open during operation of the engine, and closing upon decreasing oil pressures to a pressure above the pressure at which said normally closed pressure switch opens to establish an energizing circuit to shut-off the supply of fuel to the engine upon predetermined low oil pressure conditions, said normally closed pressure switch including;

an oil bleeder establishng constant communication between said valve chamber and said inlet and bleeding oil from said valve chamber when said check valve is closed to reduce the pressure in said chamber to accommodate the opening of said normally closed pressure switch in a delayed time interval and delay restarting of an unattended engine for said predetermined time delay interval.

2. The delay check valve and pressure switch of claim 1, including an accumulator in communication with said valve chamber and said normally closed pressure switch and accumulating oil under pressure to delay the opening of said pressure switch as oil is bled from said chamber until the pressure of the oil bleeds down to a decreasing pressure and the pressure of opening of said pressure switch.

3. The delay check valve and pressure switch of claim 2, including a main oil pressure switch in series with said normally closed pressure switch and normally open during operation of the engine and closing upon decreasing oil pressures above the pressure at which said normally closed pressure switch opens to reestablish the supply of fuel to the engine.

4. The delay check valve and pressure switch of claim 1, in which the check valve is a ball check valve and a preloaded spring biases said ball into its closed position and the oil bleeder is a bleeder tube leading axially through said ball and having communication between said inlet and said valve chamber and bleeds oil from said valve chamber when said check valve is closed as the oil pressure in the oil manifold drops below a safe operating pressure.

5. The delay check valve and pressure switch of claim 1, including an electrically energizable shut-off valve in the main fuel line to said engine, shutting down upon the closing of said normally opened pressure switch to effect the energization of said fuel shut-off valve.

6. The oil pressure delay and check valve of claim 5 in which the electrically energizable shut-off valve includes a solenoid, energizable to close the valve and connected in series with said normally open and normally closed pressure switches, and energized upon closing of said normally open pressure switch in the main oil pressure line.

7. In a shut-off for an internal combustion engine, a normally closed pressure switch in the oil manifold for the engine, a normally open pressure switch in the main oil supply line to the engine, an electrically energizable fuel shut-off valve connected in series with said switches and energizable to shut off the supply of fuel to the engine, and means connecting said normally closed pressure switch to the oil manifold to open upon predetermined decreasing pressures, comprising a delay check valve connected with the oil manifold, a pressure connection between said normally closed pressure switch and said delay check valve on the downstream side of the valve thereof, said delay check valve having a bleeder tube leading therethrough for bleeding the pressure maintaning said normally closed pressure switch closed down to a pressure to accommodate opening of said normally closed pressure switch at predetermined decreasing pressures, to cooperate with said normally open pressure switch and provide a delay in the deenergization of said electrically energizable shut-off valve and the opening of said valve.

8. The internal combustion engine shut-off of claim 7, including an accumulator connected with said check valve and accumulating oil under pressure to effect the bleeding of the oil from a predetermined low pressure down to a lower pressure through said bleeder tube, to thereby effect opening of said normally closed pressure switch upon decreasing oil pressures in a delayed time interval after the closing of said normally open pressure switch in the main oil supply line.

9. The internal combustion engine and shut-off of claim 8, in which the check valve is a ball-type of check valve having a ball biased into a closed position and having a pressure chamber on the downstream side of the valve and ball, in which the pressure chamber is in communication with the accumulator and normally closed pressure switch, and the bleeder tube bleeds oil from said chamber through said ball to effect a delay in the opening of said normally closed pressure switch and the supply of fuel to the engine through said shut-off valve in a predetermined time interval.

10. The internal combustion engine shut-off of claim 9, in which the normally closed pressure switch has a water temperature switch in series therewith to effect the shut-off of the supply of fuel to the engine upon predetermined high temperature conditions and the normally open pressure switch closes upon loss of oil pressure as the engine is shut off to maintain the fuel supply valve closed, and the normally closed pressure switch opens upon a predetermined time delay interval to effect opening of the fuel supply valve and restarting of the engine in a delayed time interval.

* * * * *